US005175081A

United States Patent [19]

Krepski et al.

[11] Patent Number: 5,175,081

[45] Date of Patent: Dec. 29, 1992

[54] POST-PROCESSSING STABILIZATION OF PHOTOTHERMOGRAPHIC EMULSIONS

[75] Inventors: Larry R. Krepski, White Bear Lake; Kumars Sakizadeh, Woodbury; Sharon M. Simpson, Lake Elmo; David R. Whitcomb, Woodbury, all of Minn.

[73] Assignee: Minnesota Mining and Manufacturing Company, St. Paul, Minn.

[21] Appl. No.: 882,359

[22] Filed: May 6, 1992

Related U.S. Application Data

[63] Continuation of Ser. No. 575,834, Aug. 31, 1990, abandoned.

[51] Int. Cl.[5] ..... G03C 1/494; G03C 1/34

[52] U.S. Cl. ..... 430/617; 430/600; 430/607; 430/611; 430/613; 430/203; 430/964

[58] Field of Search ..... 430/617, 607, 611, 613, 430/614, 964, 203, 600

[56] References Cited

U.S. PATENT DOCUMENTS

| | | | |
|---|---|---|---|
| 4,137,079 | 1/1979 | Houle | 96/55 |
| 4,138,265 | 2/1979 | Shiao | 96/114.1 |
| 4,245,033 | 1/1981 | Eida et al. | 430/353 |
| 4,288,523 | 9/1981 | Taylor | 430/537 |
| 4,304,705 | 12/1981 | Heilmann et al. | 428/461 |
| 4,378,424 | 3/1983 | Altland et al. | 430/352 |
| 4,451,561 | 5/1984 | Hirabayashi et al. | 430/619 |
| 4,837,141 | 6/1989 | Kohno et al. | 430/559 |
| 4,981,933 | 1/1991 | Fazio et al. | 430/941 |

OTHER PUBLICATIONS

Encyclopeida of Polymer Science and Engineering, vol. 11, 2nd Ed. (1988), Rasmussen et al., "Polyazlactone", pp. 558–571.

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

The post-processing stability of silver halide photothermographic emulsions is enhanced by the presence of stabilizing amounts of certain azlactones.

27 Claims, No Drawings

POST-PROCESSSING STABILIZATION OF PHOTOTHERMOGRAPHIC EMULSIONS

This is a continuation of application Ser. No. 07/575,834 filed Aug. 31, 1990, now abandoned.

FIELD OF THE INVENTION

This invention relates to photothermographic materials and in particular to post-processing stabilization of dry silver systems.

BACKGROUND OF THE ART

Silver halide photothermographic imaging materials, especially "dry silver" compositions, processed with heat and without liquid development have been known in the art for many years. Such materials are a mixture of light insensitive silver salt of an organic acid (e.g., silver behenate), a minor amount of catalytic light sensitive silver halide, and a reducing agent for the silver source.

The light sensitive silver halide is in catalytic proximity to the light insensitive silver salt such that the latent image formed by the irradiation of the silver halide serves as a catalyst nucleus for the oxidation-reduction reaction of the organic silver salt with the reducing agent when heated above 80° C. Such media are described in U.S. Pat. Nos. 3,457,075; 3,839,049; and 4,260,677. Toning agents can be incorporated to improve the color of the silver image of photothermographic emulsions as described in U.S. Pat. Nos. 3,846,136; 3,994,732 and 4,021,249. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747 and Research Disclosure 29963.

A common problem that exists with these photothermographic systems is the instability of the image following processing. The photoactive silver halide still present in the developed image may continue to catalyze print-out of metallic silver even during room light handling. Thus, there exists a need for stabilization of the unreacted silver halide with the addition of separate post-processing image stabilizers or stabilizer precursors to provide the desired post-processing stability. Most often these are sulfur containing compounds such as mercaptans, thiones, thioethers as described in Research disclosure 17029. U.S. Pat. No. 4,245,033 describes sulfur compounds of the mercapto-type that are development restrainers of photothermographic systems as do U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles such as 3-amino-5-benzothio-1,2,4-triazole as post-processing stabilizers are described in U.S. Pat. No. 4,128,557; 4,137,079; 4,138,265, and Research Disclosure 16977 and 16979.

Some of the problems with these stabilizers include thermal fogging during processing or losses in photographic sensitivity maximum density or contrast at stabilizer concentrations in which stabilization of the post-processed image can occur.

Stabilizer precursors have blocking or modifying groups that are usually cleaved during processing with heat and/or alkali. This provides the remaining moiety or primary active stabilizer to combine with the photoactive silver halide in the unexposed and undeveloped areas of the photographic material. For example, in the presence of a silver halide precursor in which the sulfur atom is blocked upon processing, the resulting silver mercaptide will be more stable than the silver halide to light, atmospheric and ambient conditions.

Various blocking techniques have been utilized in developing the stabilizer precursors. U.S. Pat. No. 3,615,617 describes acyl blocked photographically useful stabilizers. U.S. Pat. Nos. 3,674,478 and 3,993,661 describe hydroxyarylmethyl blocking groups. Benzylthio releasing groups are described in U.S. Pat. No. 3,698,898. Thiocarbonate blocking groups are described in U.S. Pat. No. 3,791,830, and thioether blocking groups in U.S. Pat. Nos. 4,335,200, 4,416,977, and 4,420,554. Photographically useful stabilizers which are blocked as urea or thiourea derivatives are described in U.S. Pat. No. 4,310,612. Blocked imidomethyl derivatives are described in U.S. Pat. No. 4,350,752, and imide or thioimide derivatives are described in U.S. Pat. No. 4,888,268. Removal of all of these aforementioned blocking groups from the photographically useful stabilizers is accomplished by an increase of pH during alkaline processing conditions of the exposed imaging material.

Other blocking groups which are thermally sensitive have also been utilized. These blocking groups are removed by heating the imaging material during processing. Photographically useful stabilizers blocked as thermally sensitive carbamate derivates are described in U.S. Pat. Nos. 3,844,797 and 4,144,072. These carbamate derivatives presumably regenerate the photographic stabilizer through loss of an isocyanate. Hydroxymethyl blocked photographic reagents which are unblocked through loss of formaldehyde during heating are described in U.S. Pat. No. 4,510,236. Development inhibitor releasing couplers releasing tetrazolylthio moieties are described in U.S. Pat. No. 3,700,457. Substituted benzylthio releasing groups are described in U.S. Pat. No. 4,678,735; and U.S. Pat. Nos. 4,351,896 and 4,404,390 utilize carboxybenzylthio blocking groups for mesoionic 1,2,4-triazolium-3-thiolates stabilizers. Photographic stabilizers which are blocked by a Michael-type addition to the carbon-carbon double bond of either acrylonitrile or alkyl acrylates are described in U.S. Pat. Nos. 4,009,029 and 4,511,644, respectively. Heating of these blocked derivatives causes unblocking by a retro-Michael reaction.

Various disadvantages attend these different blocking techniques. Highly basic solutions which are necessary to cause deblocking of the alkali sensitive blocked derivatives are corrosive and irritating to the skin. With the photographic stabilizers which are blocked with a heat removable group, it is often found that the liberated reagent or by-product, for example, acrylonitrile, can react with other components of the imaging construction and cause adverse effects.

Also, inadequate or premature release of the stabilizing moiety within the desired time during processing may occur.

Thus, there has been a continued need for improved post-processing stabilizers that do not fog or desensitize the photographic materials, and stabilizer precursors that release the stabilizing moiety at the appropriate time and do not have any detrimental effects on the photosensitive material or user of said material.

SUMMARY OF THE INVENTION

According to this invention, the incorporation of novel azlactone-functional stabilizer precursor of Formula I and/or 2-alkenyl azlactones of Formula II and/or azlactones of Formula III into the photothermographic emulsion layer or a layer adjacent to the emulsion layer stabilizes the photoactive silver halide for improved post-processing stabilization without desensiting or fogging the heat developable photographic material and process. The general formulae I, II, and III describe such compounds thereof:

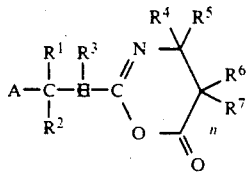

I

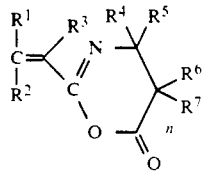

II

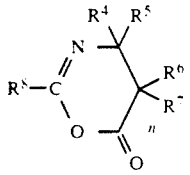

III wherein

A represents a residue of a post-processing stabilizing group AH in which a hydrogen atom of the post-processing stabilizer has been replaced by the remainder of the structure shown in Formula I;

$R^1$, $R^2$, and $R^3$ are independently hydrogen or methyl, with the proviso that $R^1$ can also represent an aryl group when $R^2$ and $R^3$ are hydrogen;

$R^4$ and $R^5$ independently represent an alkyl group, a cyclo alkyl group, an aryl group or $R^4$ and $R^5$ taken together with the carbon atom to which they are joined form a ring of 4 to 12 atoms;

$R^6$ and $R^7$ are independently hydrogen or lower alkyl, preferably C-1 to C-4 alkyl;

$R^8$ is any organic group such as alkyl groups (e.g., of 1 to 20 carbon atoms, more preferably 1 to 12 carbon atoms, and inclusive of cycloalkyl of 3 to 20 carbon atoms, preferably 5 to 8 carbon atoms), aryl groups (e.g., up to 7 ring atoms) and heterocyclic groups (preferably of C, S, N, 0 and Se atoms with up to 7 ring atoms);

and n is 0 or 1.

In this application:

"alkenyl" and "alkenylene" mean the monovalent and polyvalent residues remaining after removal of one and at least two hydrogen atoms, respectively, from an alkene containing 2 to 20 carbon atoms; functional groups which may be present are one or more aryl, amide, thioamide, ester, thioester, ketone (to include oxo-carbons), thioketone, nitrile, nitro, sulfide, sulfoxide, sulfone, disulfide, tertiary amine, ether, urethane, dithiocarbamate, quaternary ammonium and phosphonium, halogen, silyl, silyloxy, and the like, wherein the functional groups requiring substituents are substituted with hydrogen, alkyl, or aryl groups where appropriate; additionally, the alkenyl and alkenylene residues may contain one or more catenary S, O, N, P, and Si heteroatoms;

"alkyl" and alkylene" mean the monovalent and polyvalent residues remaining after removal of one and at least two hydrogen atoms, respectively, from a linear or branched chain hydrocarbon having 1 to 20 carbon atoms, functional groups and catenary heteroatoms which may be present are the same as those listed under the "alkenyl" definition;

"aryl" and "arylene" mean the monovalent and polyvalent residues remaining after removal of one and at least two hydrogen atoms, respectively, from an aromatic compound (single ring and multi- and fused-cyclic) having 5 to 12 ring atoms in which up to 5 ring atoms may be selected from S, Si, 0, N, and P heteroatoms, functional groups which also may be present are the same as those listed under the "alkenyl" definition;

"azlactone" means 2-oxazolin-5-one groups of Formula VII and 2-oxazin-6-one groups of Formula VIII

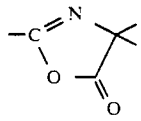

VII

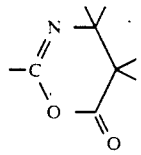

VIII

Such compounds of Formula I are Michael reaction products of selected Michael donors (AH) to 2-alkenyl azlactone Michael acceptors (Formula II) as illustrated by a nitrogen nucleophile (IV) in the equation below, to an alkenyl azlactone Michael acceptor (V) to form a Michael adduct reaction product VI.

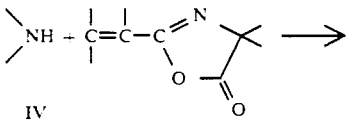

IV V

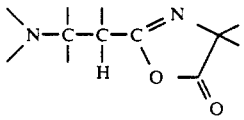

VI

DETAILED DESCRIPTION OF THE INVENTION

The addition of the novel azlactone-functional stabilizer precursors of Formula I and/or the 2-alkenyl azlactones of Formula II and/or the azlactones of Formula III into the photothermographic emulsion layer or layer adjacent to the emulsion layer provides the photoactive silver halide emulsion with improved post-processing stability without desensitizing or fogging said emulsion.

In general Formula I, A represents the residue of the "primary" post-processing stabilizer, AH, in which the hydrogen atom has been replaced by the azlactone functional "secondary" stabilizer. The addition of the alkenyl azlactone to AH blocks the activity of the primary stabilizer AH, which left unblocked and added to the emulsion at the same molar equivalent would desensitize said emulsion. After processing, the azlactone functional group releases the primary stabilizer providing improved post-processing stabilization from both the primary stabilizer and the secondary stabilizer, the azlactone moiety.

The primary stabilizer AH represents any group which links to the azlactone moiety by the loss of a hydrogen atom from a sulfur or nitrogen atom from the primary stabilizer.

AH has been defined as a post-processing stabilizing group. This is a group, which when released from the azlactone, stabilizes the image formed after processing. The group could not have been originally associated with the emulsion as the compound A-H because that compound would have been too active and would have actively suppressed image formation. The combination of processing heat in the presence of the photothermographic environment releases the group A from the azlactone at a useful time. Also the presence of azlactone group itself can give some post-processing stability. Post-processing stabilizing groups usually have a sulfur or nitrogen atom available for complexing silver ion. The compounds are usually ring structures with the sulfur and/or nitrogen within the ring or external to the ring. These compounds are well known to the ordinary skilled photographic chemist.

Suitable stabilizers are well known in the art such as nitrogen-containing substituted or unsubstituted heterocyclic rings; such as benzimidazole, benzotriazole; triazoles; tetrazoles; imidazoles; various mercapto-containing substituted or unsubstituted compounds; such as mercapto triazoles, mercapto tetrazoles; thio-substituted heterocycles; or any such compound that stabilizes the said emulsion but at such concentrations desensitizes the initial sensitometric response if left unblocked. Many of such compounds are summarized in Research Disclosure 29963 from March, 1989 entitled "Photothermographic Silver Halide Systems".

Specific examples of the novel azlactone-functional stabilizer precursors of Formula I and 2-alkenyl azlactones of Formula II are shown by the formulae below, which, however, do not limit the compounds to be used in the present invention.

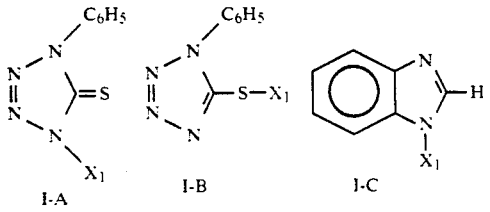

I-A I-B I-C

-continued

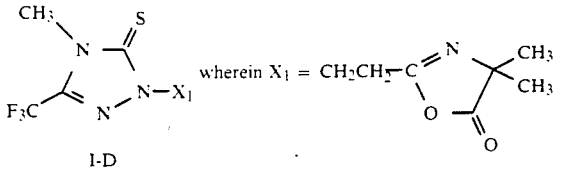

I-D

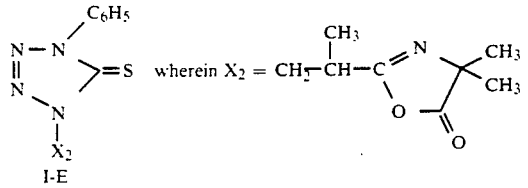

I-E

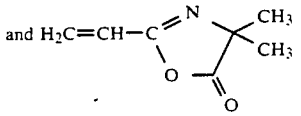

II-A

Examples of suitable 2alkenyl azlactones of Formula II include: 2-vinyl-4,4-dimethyl-2-oxazolin-5-one (II-A (VDM)), 2-isopropenyl-4,4-dimethyl-2-oxazolin-5-one, 2-vinyl-4-ethyl-4-methyl-2-oxazolin-5-one, 2-vinyl-4,4-dimethyl-1,3-oxazin-6 one and others disclosed in U.S. Pat. No. 4,304,705. The preferred 2-alkenyl azlactones is VDM (available from SNPE, Inc., Princeton, N.J.).

Examples of suitable azlactones of Formula III include 2-methyl-4,4-dimethyl-2-oxazolin-5-one, 2-ethyl-4,4-dimethyl-2-oxazolin-5-one, 2-isopropyl-4-ethyl-4-methyl-2oxazolin-5-one, 2-phenyl-4,4-dimethyl-2-oxazolin-5-one. 2-ethyl-4,4-dimethyl-1,3-oxazin-6-one, and others described by Y. S. Rao and R Filler in a review entitled "Oxazolones" contained in "Heterocyclic Compounds, Vol 45"edited by I. J. Turchi, John Wiley and Sons, Inc., New York, 1986, pp 361–729 as well as multiazlactones such as those described by J. K. Rasmussen, S. M. Heilmann and L. R. Krepski in a review entitled "Polyazlactones" contained in "Encyclopedia of Polymer Science and Engineering, Vol II," Second Edition, John Wiley and Sons, Inc., New York, 1988, pp 558–571.

The general synthesis of the stabilizer precursors in Formula I is described in the patent application entitled "Azlactone Michael Adducts", File No. 45053USAIA. Specific synthesis examples of the compounds according to the present invention are set forth below.

In all cases, structures of the compounds were confirmed by spectral analysis, including IR, proton and carbon NMR spectroscopy.

SYNTHESIS EXAMPLE 1

Synthesis of Compound I-A

A mixture of VDM (2-vinyl-4,4-dimethylazlactone) (13.9 g, 0.10 mole) and 1-phenyl-1H-tetrazole-5-thiol (17.8 g, 0.1 mole) was heated at 100° C. overnight to yield the desired product.

Synthesis of Compound I-B

VDM (13.9 g, 0.10 mole) was cooled to 0° C. and mixed with 1-phenyl-1H-tetrazole-5-thiol (17.8 g, 0.10 mole). The mixture was allowed to warm to room temperature and kept at this temperature overnight to give a quantitive yield of the desired product as a white solid. Structure of the product was confirmed by spectral analyses.

SYNTHESIS EXAMPLE 2

Synthesis of Compound I-C

A mixture of VDM (13.9 g, 0.10 mole) and benzimidazole (11.8 g, 0.10 mole) was heated at 100° C. overnight to yield the desired product.

SYNTHESIS EXAMPLE 3

Synthesis of Compound I-D

A reaction flask equipped with a magnetic stirrer was charged with 3-trifluoromethyl-4-methyl-5-mercapto-1,2,4 triazole (MFT) (36 g, 0.2 mole), vinylazlactone (VDM) (55.6 g, 0.4 mole) and 1,8-diazabicyclo[5.4.0-.]undec-7-ene (DBU) (1 ml). The reaction mixture was then stirred at 65° C. for 15 hours. The gummy material obtained was dissolved in toluene (220 ml) at room temperature and filtered. Addition of n-hexane (200 ml) to the cold solution of the filtrate (kept in an ice bath) yielded white crystals. m.p. 73° C.; 54g (88%).

SYNTHESIS EXAMPLE 4

Synthesis of Compound I-E

A mixture of IDM (2-isopropenyl-4,4-dimethylazlactone) (7.65 g, 0.05 mole), 1-phenyl-1H-tetrazole-5-thiol (8.9 g, 0.05 mole) and DBU (1,8-diazabicyclo[5.4.0]undec-7-ene) (0.38 g, 2.5 mmole) was heated at 60° C. for 21 hours, then 100° C. for 3 hours to give the desired product.

The amounts of the above described compounds according to the present invention which are added can be varied depending upon the particular compound used and upon the photothermographic emulsion-type. However, they are preferably added in an amount of $10^{-3}$ to 50 mol, and more preferably from $10^{-2}$ to 10 mol, per mol of silver halide in the emulsion layer.

The photothermographic dry silver emulsions of this invention may be constructed of one or more layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers. Multicolor photothermographic dry silver constructions contain sets of these bilayers for each color. Color forming layers are maintained distinct from each other by the use of functional or non-functional barrier layers between the various photosensitive layers as described in U.S. Pat. No. 4,460,681.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material constitutes from about 5 to 30 percent by weight of the imaging layer. The second layer in a two-layer construction or in the bilayer of a multi-color construction would not affect the percentage of the silver source material desired in the photosensitive single imaging layer.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salts include silver salts of organic compounds having a carboxy group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linoleate, silver butyrate and silver camphorate, mixtures thereof, etc. Silver salts which are substituted with a halogen atom of a hydroxyl group can also be effectively used. Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(S-ethylglycolamido) benzothiazole, a silver salt of thioglycolic acid such as a silver salt of a S-alkyl thioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen substituted benzotriazole, such as a silver salt of 5-chlorobenzotriazole, etc., a silver salt of carboimidobenzotriazole, etc., a silver salt of 1,2,4-triazole, of 1-H-tetrazole as described in U.S. Pat. No. 4,220,709, a silver salt of imidazole and an imidazole derivative, and the like.

It is also found convenient to use silver halfsoaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or 5 percent of free behenic acid and analyzing about 25.2 percent silver may be used.

The method used for making silver soap dispersions is well known in the art and is disclosed in Research Disclosure April 1983 (22812) ibid October 1983 (23419) and U.S. Pat. No. 3,985,565.

The light sensitive silver halide used in the present invention can be employed in a range of 0.0005 mol to 5 mol and, preferably, from 0.005 mol to 1.0 mol per mol of organic silver salt.

The silver halide may be any photosensitive silver halide such as silver bromide, silver iodide, silver chloride, silver bromoiodide, silver chlorobromoiodide, silver chlorobromide, etc.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T.. James "The Theory of the Photographic Process", Fourth Edition, Chapter 5, pages 149 to 169.

The silver halide may be added to the emulsion layer in any fashion which places it in catalytic proximity to the silver source.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen containing compound in the organic silver salt prepared to partially convert the silver of the organic silver salt to silver halide.

Methods of preparing these silver halide and organic silver salts and manners of blending them are described in Research Disclosures, No. 170–29, Japanese Patent Applications Nos. 32928/75 and 42529/76, U.S. Pat. No. 3,700,458, and Japanese Patent Applications Nos. 13224/74 and 17216/75.

The use of preformed silver halide emulsions of this invention can be unwashed or washed to remove soluble salts. In the latter case the soluble salts can be removed by chill-setting and leaching or the emulsion can be coagulation washed, e.g., by the procedures described in Hewitson, et al., U.S Pat. No. 2,618,556; Yutzy et al., U.S. Pat No. 2,614,928; Yackel, U.S. Pat. No. 2,565,418;; Hart et al., U.S. Pat. No. 3,241,969; and Waller et al., U.S. Pat. No. 2,489,341 The silver halide grains may have any crystalline habit including, but not limited to cubic, tetrahedral, orthorhombic, tabular, laminar, platelet, etc.

Photothermographic emulsions containing preformed silver halide in accordance with this invention can be sensitized with chemical sensitizers, such as with reducing agents; sulfur, selenium or tellurium compounds; gold, platinum or palladium compounds, or combinations of these. Suitable chemical sensitization procedures are described in Shepard, U.S. Pat No. 1,623,499; Waller, U.S. Pat. No. 2,399,083; McVeigh, U.S. Pat. No. 3,297,447; and Dunn, U.S. Pat. No. 3,297,446.

The light-sensitive silver halides can be spectrally sensitized with various known dyes including cyanine, styryl, hemicyanine, oxonol, hemioxonol and xanthene dyes Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malonitrile nucleus and a pyrazolone nucleus. In the above described cyanine and merocyanine dyes, those having imino groups or carboxyl groups are particularly effective. Practically, the sensitizing dye to be used in the present invention is properly selected from known dyes as described in U.S. Pat. No. 3,761,279, 3,719,495 and 3,877,943, British Pat Nos. 1,466,201, 1,469,117 and 1,422,057, Japanese Patent Application (OPI) Nos. 27924/76 and 156424/75, and so on, and can be located in the vicinity of the photocatalyst according to known methods used in the above-described examples. These spectral sensitizing dyes are used in amounts of about $10^{-4}$ mol to about 1 mol per 1 mol of photocatalyst.

The reducing agent for silver ion may be any material, preferably organic material, which will reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In a two-layer construction, if the reducing agent is in the second layer, slightly high proportions, of from about 2 to 15 percent tend to be more desirable.

A wide range of reducing agents have been disclosed in dry silver systems including amidoximes such as phenylamidoxime, 2-thienylamidoxime and p-phenoxyphenylamidoxime, azine, e.g., 4-hydroxy-3,5-dimethoxybenzaldehyde azine; a combination of aliphatic carboxylic acid aryl hydrazides and ascorbic acid, such as 2,2-bis(hydroxymethyl)propionyl-beta-phenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenyl hydrazine, hydroxamic acids such as phenylhydroxamic acid, p-hydroxyphenyl hydroxamic acid, and beta-alanine hydroxamic acid; a combination of azines and sulphonamidophenols, e.g., phenothiazine and 2,6-dichloro-4-benzenesulphonamidophenol; alpha-cyanophenylacetic acid derivatives such as ethyl-alpha-cyano-2-methylphenylacetate, ethyl alpha-cyanophenylacetate; bis-beta-naphthols as illustrated by 2,2'-dihydroxy-1,1'-binaphthyl, 6,6'-dibromo-2,2'-dihydroxy-1,1'-binaphthyl, and bis(2-hydroxy-1-(naphthyl)methane; a combination of bis-beta-naphthol and a 1,3-dihydroxybenzene derivative, e.g., 2,4-dihydroxybenzophenone or 2,4'-dihydroxyacetophenone; 5-pyrazolones such as 3-methyl-1-phenyl-5-pyrazolone; reductones as illustrated by dimethylamino hexose reductone, anhydro dihydro amino hexose reductone, and anhydro dihydro piperidone hexose reductone; sulphonamidophenol reducing agents such as 2,6-dichloro-4-benzensulphonamidophenol, and p-benzenesulphonamidophenol; 2-phenylindane-1,3-dione and the like; chromans such as 2,2-dimethyl-7-t-butyl-6-hydroxychroman; 1,4-dihydro-pyridines such as 2,6-dimethoxy-3,5-dicarbetoxy-1,4-dihydropyridine; bisphenols e.g., bis(2-hydroxy-3-t-butyl-5-methylphenyl)methane, 2,2-bis(4-hydroxy-3-methylphenyl)propane, 4,4-ethylidenebis(2-tert-butyl-6-methylphenol), and 2,2-bis(3,5-dimethyl-4-hydroxyphenyl)propane; ascorbic acid derivatives, e.g., 1-ascorbylpalmitate, ascorbylstearate and unsaturated aldehydes and ketones, such as benzyl and diacetyl; 3-pyrazolidones and certain indane-1,3-diones.

The literature discloses additives, "toners", which improve the image.

Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides, e.g., N-hydroxy-1,8-naphthalimide; cobalt complexes, e.g., cobaltic hexamine trifluoroacetate; mercaptans as illustrated by 3-mercapto1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryl dicarboximides, e.g. (N-dimethylaminomethyl)phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene bis(1-carbamoyl-3,5-dimethylpyrazole), 1,8-(3,6-diazaoctane)bis-(isothiuronium trifluoroacetate) and 2-(tribromomethylsulphonyl)-benzothiazole); and merocyanine dyes such as 3-ethyl-5[(3-ethyl-2-benzothiazolinylidene)-1-methylethylidene]-2-thio-2,4-oxazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulphinic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulphates, e.g., ammonium peroxydisulphate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g, 3,6-dimercapto-1,4-diphenyl-1H,4H-2,3*a*,5,6*a*-tetrazapentalene, and 1,4-di(o-chloro-phenyl)3,6-dimercapto-1H,4H-2,3a,5,6a-tetrazapentalene.

A number of methods have been proposed for obtaining color images with dry silver systems. Such methods include incorporated coupler materials, e.g., a combination of silver benzotriazole, well known magenta, yellow and cyan dye-forming couplers, aminophenol developing agents, a base release agent such as guanidinium trichloroacetate and silver bromide in poly(vinyl butyral); a combination of silver bromoiodide, sulphonamidophenol reducing agent, silver behenate, poly(vinyl butyral), an amine such as n-octadecylamine and 2-equivalent or 4-equivalent cyan, magenta or yellow dye-forming couplers; incorporating leuco dye bases which oxidize to form a dye image, e.g., Malachite Green, Crystal Violet and pararosaniline; a combination of in situ silver halide, silver behenate, 3-methyl-1-phenylpyrazolone and N,N'-dimethyl-p phenylenediamine hydrochloride; incorporating phenolic leuco dye reducing agents such as 2-(3,5-di-tert-butyl-4-hydroxyphenyl)-4,5-diphenylimidazole, and bis(3,5-di-tert-butyl-4-hydroxyphenyl)phenylmethane, incorporating azomethine dyes or azo dye reducing agents; silver dye bleach process, e.g., an element comprising silver behenate, behenic acid, poly(vinyl butyral), poly(vinylbutyral)peptized silver bromoiodide emulsion, 2,6-dichloro-4-benzenesulphonamidophenol, 1,8-(3,6 diazaoctane)bis-isothiuronium-p-toluene sulphonate and an azo dye was exposed and heat processed to obtain a negative silver image with a uniform distribution of dye which was laminated to an acid activator sheet comprising polyacrylic acid, thiourea and p-toluene sulphonic acid and heated to obtain well defined positive dye images; and incorporating amines such as aminoacetanilide (yellow dye-forming), 3,3'-dimethoxybenzidine (blue dye-forming) or sulphanilanilide (magenta dye forming) which react with the oxidized form of incorporated reducing agents such as 2,6-dichloro-4-benzene-sulphonamido-phenol to form dye images. Neutral dye images can be obtained by the addition of amines such as behenylamine and p-anisidine.

Leuco dye oxidation in such silver halide systems are disclosed in U.S. Pat. Nos. 4,021,240, 4,374,821, 4,460,681 and 4,883,747.

Silver halide emulsions containing the stabilizers of this invention can be protected further against the additional production of fog and can be stabilized against loss of sensitivity during keeping. Suitable anti-foggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et. al., British Patent No. 623,448; nitron; nitroindazoles; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions of the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; Lestina et al. U.S. Pat. Nos. 3,432,300 and 3,698,909; Stern et al. U.S. Pat. No. 3,574,627; Brannock et al. U.S. Pat. No. 3,573,050; Arai et al. U.S. Pat. No. 3,764,337 and Smith et al. U.S. Pat. No. 4,042,394.

Photothermographic elements containing emulsion layers stabilized according to the present invention can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

Photothermographic elements containing emulsion layers stabilized as described herein can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Emulsions stabilized in accordance with this invention can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymer is polyvinyl butyral, butethyl cellulose, methacrylate copolymers, maleic anhydride ester copolymers, polystyrene, and butadiene-styrene copolymers.

Optionally these polymers may be used in combination of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing the stabilizer of the invention can be coated on a wide variety of supports. Typical supports include polyester film, subbed polyester film, poly(ethylene terephthalate)film, cellulose nitrate film, cellulose ester film, poly(vinyl acetal) film, polycarbonate film and related or resinous materials, as well as glass, paper metal and the like. Typically, a flexible support is employed, especially a paper support, which can be partially acetylated or coated with baryta and/or an alphaolefin polymer, particularly a polymer of an alpha-olefin containing 2 to 10 carbon atoms such as polyethylene, polypropylene, ethylenebutene copolymers and the like.

The substrate with backside resistive heating layer may also be used in color photothermographic imaging systems such as shown in U.S. Pat. No. 4,460,681 and 4,374,921.

Photothermographic emulsions of this invention can be coated by various coating procedures including dip coating, air knife coating, curtain coating, or extrusion coating using hoppers of the type described in Benguin, U.S. Pat. No. 2,681,294. If desired, two or more layers may be coated simultaneously by the procedures described in Russell, U.S. Pat. No. 2,761,791 and Wynn British Patent No. 837,095.

The present invention will be illustrated in detail in reference to the following examples, but the embodiment of the present invention is not limited thereto.

EXAMPLE 1

A dispersion of silver behenate half soap was made at 10% solids in toluene and acetone by homogenization. To 127 g of this silver half soap dispersion was added 252 g methyl ethyl ketone, 104 g isopropyl alcohol and 0.5 g of polyvinylbutyral. After 15 minutes of mixing, 4 ml of mercuric bromide (0.36/10 ml methanol) were added. Then 8.0 ml of calcium bromide (0.236 g/10 ml methanol) was added 30 minutes later. After two hours of mixing, 27.0 g of polyvinylpyrrolidone was added, and 27.0 g of polyvinylbutyral was added one hour later.

To 32.1 g of the prepared silver premix described above was added 2.0 ml of the sensitizing dye A (0.045 g/50 ml of methanol) shown below.

A

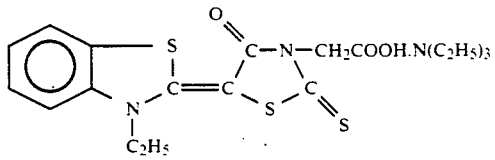

After 20 minutes, a yellow color-forming leuco dye solution was added as shown below.

| Component | Amount |
|---|---|
| Leuco Dye B | 0.275 g |
| Tribenzylamine | 0.24 g |
| Phthalazinone | 0.14 g |
| Tetrahydrofuran | 6.0 ml |

The leuco dye is disclosed in U.S. Pat. No. 4,883,747 and has the following formula:

B

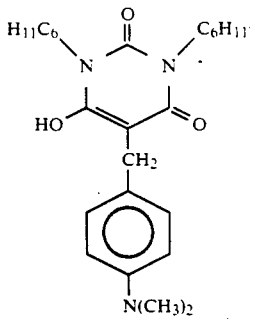

After sensitization with the dye and the addition of the leuco base dye solution, Compounds I-A and I-B were added in the amounts of 0.2 ml or 1.0 ml at a concentration of 0.1 g/5 ml of methanol to a 9.9 g aliquot of the yellow coating solution. The resulting solutions were coated along with a solution not containing any stabilizer precursor at a wet thickness of 3 mils and dried at 82° C. in an oven for 5 minutes onto a vesicular polyester base. A topcoat solution was coated at a wet thickness of 3 mils over the silver halide layer and dried at 82° C. in an oven for 5 minutes. The topcoat solution consisted of 7% polyvinyl alcohol in an approximate 50:50 mixture of water and methanol and 0.2% phthalazine.

The samples were exposed for $10^{-3}$ seconds through a 47B Wratten filter and a 0 to 3 continuous wedge and developed by heating to approximately 138° C. for 6 seconds. The density of the dye was measured using a blue filter of a computer densitometer. Post-processing stability was measured by exposing imaged samples to 1200 ft-candles of illumination for 6 hours at 65% relative humidity and 26.7° C. The initial sensitometric data are shown below:

| | Dmin | Dmax | Speed[1] | Contrast[2] |
|---|---|---|---|---|
| Control (0.0 ml) | 0.13 | 2.47 | 1.99 | 5.54 |
| 0.2 ml I-A | 0.14 | 2.34 | 1.94 | 6.13 |
| 1.0 ml I-A | 0.14 | 1.68 | 1.96 | 4.41 |
| 0.2 ml I B | 0.13 | 2.39 | 1.93 | 6.26 |
| 1.0 ml I-B | 0.13 | 1.73 | 2.01 | 4.43 |

[1]Log exposure corresponding to density of 0.6 above Dmin.
[2]Average contrast measured by the slope of the line joining density points 0.3 and 0.9 above Dmin.

The post-processing print stability results are shown below:

| | ΔDmin | ΔDmax |
|---|---|---|
| Control (0.0 ml) | +0.53 | −0.10 |
| 0.2 ml I-A | +0.33 | −0.13 |
| 1.0 ml I-A | +0.26 | −0.11 |
| 0.2 ml I-B | +0.36 | −0.10 |
| 1.0 ml I-B | +0.25 | −0.10 |

At the 0.2 ml addition of compound I-A or I-B, a greater than 32% Dmin post-processing improvement vs. unstabilized control was observed without any effect on initial sensitometric responses.

EXAMPLE 1A (COMPARISON)

To 9.9 g of the yellow silver halide coating solution as described in Example 1 was added 0.5 ml or 1.0 ml of 1-phenyl-5-mercapto-tetrazole (PMT) at a concentration of 0.1 g/5 ml methanol. The silver solutions and topcoats were coated, exposed and processed as described in Example 1. The initial sensitometric data are shown below.

| | Dmin | Dmax | Speed[1] | Contrast[2] |
|---|---|---|---|---|
| Control (0.0 ml) | 0.13 | 2.30 | 2.03 | 4.94 |
| 0.5 ml PMT | 0.13 | 1.72 | 2.15 | 4.06 |
| Control (0.0 ml) | 0.13 | 2.47 | 1.99 | 5.54 |
| 1.0 ml PMT | 0.13 | 0.81 | 2.64 | — |

[1]Log exposure corresponding to density of 0.6 above Dmin.
[2]Average contrast measured by the slope of the line joining density points 0.3 and 0.9 above Dmin.

The post-processing print stability was measured as described in Example 1 and the results are shown below.

| | ΔDmin | ΔDmax |
|---|---|---|
| Control (0.0 ml) | +0.46 | −0.20 |
| 0.5 ml PMT | +0.29 | −0.14 |
| Control (0.0 ml) | +0.53 | −0.10 |
| 1.0 ml PMT | +0.25 | −0.07 |

At these concentrations of PMT, significant desensitization of the silver halide emulsion has occurred for post-processing Dmin improvement greater than 40%. In Example 1, PMT was significantly blocked by the azlactone group to minimize any desensitization effects but still allowed the release of PMT for the Dmin post-processing improvements observed in Example 1-A with the unblocked PMT stabilizer.

EXAMPLE 2

To 9.9 g of the yellow silver halide coating solution as described in Example 1 was added 1.0 of compound II-A at a concentration of 0.1 g/5 ml in methanol. The silver solutions and topcoats were coated, exposed, and processed as described in Example 1. The initial sensitometric data are shown below.

| | Dmin | Dmax | Speed[1] | Contrast[2] |
|---|---|---|---|---|
| Control (0.0 ml) | 0.12 | 2.22 | 1.84 | 4.52 |
| 1.0 ml II-A | 0.11 | 2.26 | 1.79 | 4.94 |

[1]Log exposure corresponding to density of 0.6 above Dmin.
[2]Average contrast measured by the slope of the line joining density points 0.3 and 0.9 above Dmin.

The post processing print stability was measured as described in Example 1 and the results are shown below.

| | ΔDmin | ΔDmax |
|---|---|---|
| Control (0.0 ml) | +0.47 | +0.20 |
| 1.0 ml II-A | +0.43 | +0.11 |

With no effect on the initial sensitometric responses, compound II-A improves the Dmin post-processing stability approximately 10%. Thus, the compound II-A functions as a post-processing stabilizer and will contribute to the overall post-processing Dmin improvement as the blocking moiety to post-processing stabilizer precursors.

EXAMPLE 3

To 9.9 g of a yellow silver halide solution similar to Example 1, was added 0.2 ml or 0.5 ml of compound I-E at a concentration of 0.2 g/5 ml of methanol. A similar topcoat was coated over the yellow silver layer as described in Example 1. The coatings were exposed and processed as described in Example 1 and the initial sensitometric data are shown below.

| | Dmin | Dmax | Speed[1] | Contrast[2] |
|---|---|---|---|---|
| Control (0.0 ml) | 0.11 | 2.46 | 1.77 | 5.09 |
| 0.2 ml I-E | 0.13 | 2.41 | 1.77 | 4.77 |
| 0.5 ml I-E | 0.15 | 2.25 | 1.79 | 3.50 |

[1]Log exposure corresponding to density of 0.6 above Dmin.
[2]Average contrast measured by the slope of the line joining density points 0.3 and 0.9 above Dmin.

The post-processing results are shown below.

| | ΔDmin | ΔDmax |
|---|---|---|
| Control (0.0 ml) | +0.48 | −0.02 |
| 0.2 ml I-E | +0.37 | −0.03 |
| 0.5 ml I-E | +0.26 | −0.04 |

A 23% post-processing Dmin improvement was observed at the 0.2 ml addition of compound I-E without significant effects on the initial sensitometric responses.

EXAMPLE 4

A magenta color-forming silver halide dispersion was prepared by using 502 g of the silver half soap dispersion of Example 1 and adding 0.4 g of polyvinylbutyral. After 15 minutes of mixing, a 0.5 g/9.75 g mercuric acetate in methanol solution and a 0.55 g/18.4 g calcium bromide in methanol solution wee added. Then an additional 0.55 g/18.4 g calcium bromide in methanol solution was added 30 minutes later. After 45 minutes of mixing, 49.8 g of polyvinylbutyral was added.

To 35.8 g of the prepared silver premix described above was added 1.4 ml of the sensitizing dye C (0.021 g/100 ml of methanol) shown below.

C

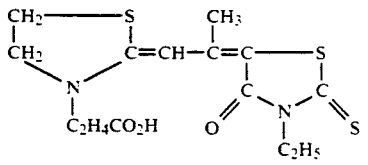

After 30 minutes, a magenta color-forming leuco dye solution was added as shown below.

| Component | Amount |
|---|---|
| Leuco Dye D | 0.593 g |
| Phthalazinone | 0.901 g |
| Tetrahydrofuran | 47.6 g |
| VAGH (Union Carbide) | 2.2 g |
| Polyvinylbutyral | 10.2 g |

The leuco dye is disclosed in U.S. Pat. No. 4,795,697 and has the following formula.

D

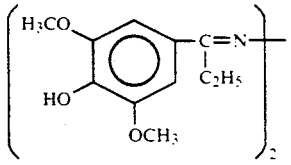

A topcoat solution wa prepared consisting of 24.0% polystyrene resin in approximately 52% tetrahydrofuran, 17% toluene, 2% acetone and 5% methanol.

To 10.0 g of the magenta silver coating solution was added 0.2 ml or 1.0 ml of compound I-C at a concentration of 0.2 g/5 ml of methanol. The magenta silver layer and topcoat are coated simultaneously at a wet thickness of 2 mils, respectively and dried for 5 minutes at 82° C.

The samples were exposed for $10^{-3}$ seconds through a 58 Wratten filter and a 0 to 3 continuous wedge and developed by heating to approximately 138° C. for 6 seconds.

The density of the dye for each sample was measured using a green filter of a computer densitometer. Post-processing stability was measured by exposing imaged samples to 1200 ft-candles of illumination for 7 hours at 65% relative humidity and 26.7° C. The initial sensitometric data are shown below.

| | Dmin | Dmax | Speed[1] | Contrast[2] |
|---|---|---|---|---|
| Control (0.0 ml) | 0.11 | 1.76 | 2.03 | 2.12 |
| 0.2 ml I-C | 0.11 | 1.74 | 2.04 | 2.16 |
| 1.0 ml I-C | 0.12 | 1.12 | 2.83 | 1.38 |

[1]Log exposure corresponding to density of 0.6 above Dmin.
[2]Average contrast measured by the slope of the line joining density points 0.3 and 0.9 above Dmin.

The post-processing print stability was measured and the results are shown below.

| | ΔDmin | ΔDmax |
|---|---|---|
| Control (0.0 ml) | +0.19 | −0.14 |
| 0.2 ml I-C | +0.15 | −0.12 |
| 1.0 ml I-C | +0.08 | −0.32 |

At a 0.2 ml addition of I-C, 21% Dmin post-processing improvement was observed before the initial sensitometric response was affected.

EXAMPLE 4-A (COMPARISON)

To 10.0 g of the magenta silver halide coating solution as described in Example 4, was added 0.35 ml or 1.0 ml of benzimidazole (BI) at a concentration of 0.1 g/5 ml of methanol. The silver solutions and topcoat were coated, exposed, and processed as described in Example 4. The initial sensitometric data are shown below.

| | Dmin | Dmax | Speed[1] | Contrast[2] |
|---|---|---|---|---|
| Control (0.0 ml) | 0.09 | 1.71 | 1.96 | 1.87 |
| 0.35 ml BI | 0.09 | 1.60 | 2.29 | 1.77 |
| 1.0 ml BI | 0.08 | 1.25 | 2.72 | 1.44 |

[1]Log exposure corresponding to density of 0.6 above Dmin.
[2]Average contrast measured by the slope of the line joining density points 0.3 and 0.9 above Dmin The post-processing print stability was measured as described in Example 4 and the results are shown below.

| | ΔDmin | ΔDmax |
|---|---|---|
| Control (0.0 ml) | +0.16 | −0.22 |
| 0.35 ml BI | +0.14 | −0.27 |
| 1.0 ml BI | +0.10 | −0.31 |

At these concentrations of BI, significant desensitization of the silver halide emulsion has occurred for the post-processing Dmin improvement of 12%. In Example 4, BI was significantly blocked (0.2 ml) by the azlactone group to minimize any desensitization effects but still allowed the release of BI for the Dmin post-processing improvements observed in Example 4-A with the unblocked BI stabilizer.

EXAMPLE 5

A two color formulation was studied with compound I-D. To 10.0 g of a yellow silver solution similar to Example 1, was added 0.45 ml or 0.6 ml of compound I-D at a concentration of 0.4 g/5 ml of ethanol. A similar topcoat was coated over the yellow silver layer as described in Example 1. In addition to the yellow silver halide and topcoat layers, a magenta color-forming silver halide layer and topcoat as described in Example 4 were coated simultaneously over the yellow topcoat. The samples were exposed and processed as described in Example 1. The initial sensitometric data are shown below.

| | Dmin | Dmax | Speed[1] | Contrast[2] |
|---|---|---|---|---|
| Control (0.0 ml) | 0.16 | 1.65 | 1.84 | 4.83 |
| 0.45 ml I-D | 0.16 | 1.62 | 1.78 | 5.03 |
| 0.6 ml I-D | 0.16 | 1.63 | 1.82 | 4.33 |

[1]Log exposure corresponding to density of 0.6 above Dmin.
[2]Average contrast measured by the slope of the line joining density points 0.3 and 0.9 above Dmin.

The post-processing print stability was measured and the results are shown below.

| | ΔDmin | ΔDmax |
|---|---|---|
| Control (0.0 ml) | +0.53 | +0.02 |
| 0.45 ml I-D | +0.28 | 0 |
| 0.6 ml I-D | +0.27 | −0.02 |

At these concentrations, approximately a 50% Dmin post-processing improvement was observed with no effect on the initial sensitometric responses.

EXAMPLE 5-A (COMPARISON)

To 10.0 g of the yellow silver halide coating solution described in Example 5, was added 1.0 ml of 3-trifluoromethyl-4-methyl-5-mercapto-1,2,4-triazole (MFT) at a concentration of 0.2 g/4 ml of ethanol. The topcoat, magenta silver and topcoat solutions were coated over the yellow silver halide layer as described in Example 5. The samples were exposed and processed as described in Example 1. The initial sensitometric data are shown below.

| | Dmin | Dmax | Speed[1] | Contrast[2] |
|---|---|---|---|---|
| Control (0.0 ml) | 0.13 | 1.73 | 1.95 | 3.63 |
| 1.0 ml MFT | 0.15 | .63 | — | — |

[1]Log exposure corresponding to density of 0.6 above Dmin.
[2]Average contrast measured by the slope of the line joining density points 0.3 and 0.9 above Dmin.

The post-processing print stability was measured and the results are shown below.

| | ΔDmin | ΔDmax |
|---|---|---|
| Control (0.0 ml) | +0.51 | −0.02 |
| 1.0 ml MFT | +0.24 | — |

At this concentration of MFT, significant desensitization of the silver halide emulsion has occurred for the Dmin post-processing improvement of 53%. In Example 5, MFT was blocked by the azlactone group to minimize any desensitization effects but still allowed the release of MFT for the Dmin post-processing improvements observed in Example 5-A with the unblocked MFT stabilizer.

What is claimed is:

1. A photothermographic emulsion comprising a silver halide, silver source material, reducing agent for silver ion, binder and a post-processing stabilizing amount of an azlactone represented by any one of the formulae:

I

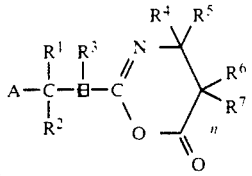

II

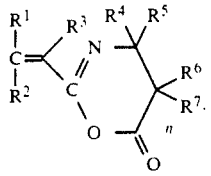

III

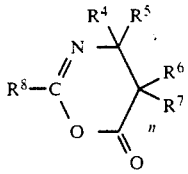

wherein

A represents a residue of post-processing stabilizer compound in which a hydrogen atom of the post-processing stabilizer compound has been replaced by

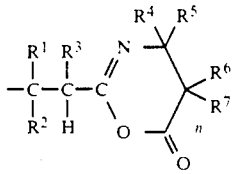

wherein $R^1$ is hydrogen, methyl or aryl, $R^2$ and $R^3$ are independently hydrogen or methyl and with the proviso that $R^1$ can represent an aryl group only when $R^2$ and $R^3$ are hydrogen;

$R^4$ and $R^5$ independently represent an alkyl group, a cyclo alkyl group, an aryl group or $R^4$ and $R^5$ taken together with the carbon atom to which they are joined form a ring of 4 to 12 atoms;

$R^6$ and $R^7$ are independently hydrogen or lower alkyl;

$R^8$ is any organic group selected from the group consisting of alkyl groups of 1 to 20 carbon atoms, aryl groups and heterocyclic groups with up to 7 ring atoms; and n is 0 or 1.

2. The emulsion of claim 1 wherein said azlactone is represented by Formula I.

3. The emulsion of claim 1 wherein said azlactone is represented by Formula II.

4. The emulsion of claim 1 wherein said azlactone is represented by Formula III.

5. The emulsion of claim 1 wherein said silver source material comprises the silver salt of an organic acid.

6. The emulsion of claim 1 wherein said silver source material comprises silver behenate.

7. The emulsion of claim 2 wherein said silver source material comprises silver behenate.

8. The emulsion of claim 3 wherein said silver source material comprises silver behenate.

9. The emulsion of claim 2 wherein n is 1.

10. The emulsion of claim 3 wherein n is 1.

11. The emulsion of claim 6 wherein n is 1.

12. The emulsion of claim 7 wherein n is 1.

13. The emulsion of claim 2 wherein n is 0.

14. The emulsion of claim 3 wherein n is 0.

15. The emulsion of claim 6 wherein n is 0.

16. The emulsion of claim 7 wherein n is 0.

17. The emulsion of claim 2 wherein A is selected from the group consisting of benzotriazoles, benzimidazoles, triazoles, tetrazoles, imidazoles, mercaptotetrazoles, mercaptotriazoles, and thio-substituted heterocyclics.

18. The emulsion of claim 7 wherein A is selected from the group consisting of benzotriazoles, benzimidazoles, triazoles, tetrazoles, imidazoles, mercaptotetrazoles, mercaptotriazoles, and thio-substituted heterocyclics.

19. The emulsion of claim 13 wherein A is selected from the group consisting of benzotriazoles, benzimidazoles, triazoles, tetrazoles, imidazoles, mercaptotetrazoles, mercaptotriazoles, and thio-substituted heterocyclics.

20. The emulsion of claim 15 wherein A is selected from the group consisting of benzotriazoles, benzimidazoles, triazoles, tetrazoles, imidazoles, mercaptotetrazoles, mercaptotriazoles, and thio-substituted heterocyclics.

21. A photothermographic emulsion comprising a photographic silver halide, silver source material, reducing agent for silver ion, binder and a post-processing stabilizing amount of an azlactone represented by any one of the formulae:

I

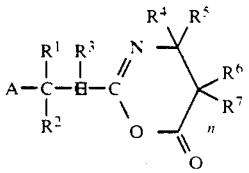

II

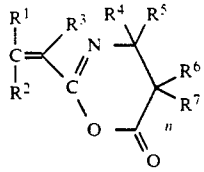

III

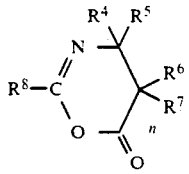

wherein

A represents a residue of a post-processing stabilizer compound in which a hydrogen atom of the post-processing stabilizer compound has been replaced by

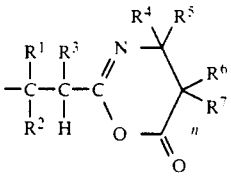

wherein $R^1$ is selected from hydrogen, methyl or aryl, $R^2$ and $R^3$ are independently hydrogen or methyl and with the proviso that $R^1$ can represent an aryl group only when $R^2$ and $R^3$ are hydrogen;

$R^4$ and $R^5$ independently represent an alkyl group, a cycloalkyl group, an aryl group or $R^4$ and $R^5$ taken together with the carbon atom to which they are joined from a ring of 4 to 12 atoms;

$R^6$ and $R^7$ are independently hydrogen or lower alkyl of 1 to 4 carbon atoms;

$R^8$ is any organic group and n is 0 or 1.

22. The emulsion of claim 21 wherein $R^8$ is selected from the group consisting of alkyl groups of 1 to 12 carbon atoms, cycloalkyl groups of 3 to 20 carbon atoms, aryl 1 groups, and heterocyclic ring groups of only C, S, N, O or Se atoms with up to 7 ring atoms.

23. A photothermographic emulsion comprising a photographic silver halide, silver source material, reducing agent for silver ion, binder and a post-processing stabilizing amount of an azlactone represented by any one of the formulae:

II

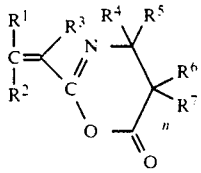

III

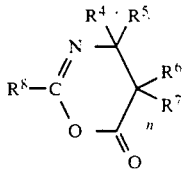

wherein $R^1$ is hydrogen, methyl, or aryl, $R^2$ and $R^3$ are independently hydrogen or methyl and with the proviso that $R^1$ can represent an aryl group only when $R^2$ and $R^3$ are hydrogen;

$R^4$ and $R^5$ independently represent an alkyl group, a cyclo alkyl group, an aryl group or $R^4$ and $R^5$ taken together with the carbon atom to which they are joined form a ring of 4 to 12 atoms;

$R^6$ and $R^7$ are independently hydrogen or lower alkyl;

$R^8$ is any organic group selected from the group consisting of alkyl groups, aryl groups and heterocyclic groups; and n is 0 or 1.

24. The emulsion of claim 23 wherein said silver source material comprises the silver salt of an organic acid.

25. The emulsion of claim 23 wherein said silver source material comprises silver behenate.

26. The emulsion of claim 23 wherein n is 1.

27. The emulsion of claim 24 wherein n is 1.

* * * * *

UNITED STATES PATENT AND TRADEMARK OFFICE

CERTIFICATE OF CORRECTION

PATENT NO. : 5,175,081

DATED : December 29, 1992

INVENTOR(S) : Krepski et al.

It is certified that error appears in the above-indentified patent and that said Letters Patent is hereby corrected as shown below:

Col. 3, Please replace all three diagrams with the following:

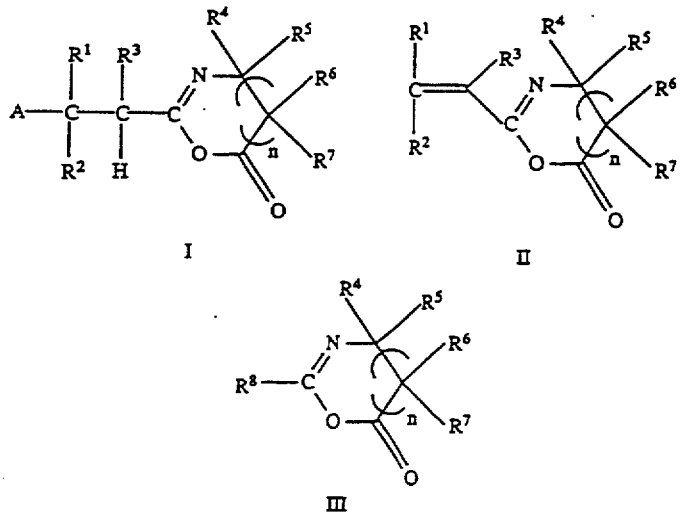

I II III

Col. 17, line 8, Replace "wee" with --were--

Col. 17, line 45, Replace "wa" with --was--

UNITED STATES PATENT AND TRADEMARK OFFICE

CERTIFICATE OF CORRECTION

PATENT NO. : 5,175,081

DATED : December 29, 1992

INVENTOR(S) : Krepski et al.

It is certified that error appears in the above-indentified patent and that said Letters Patent is hereby corrected as shown below:

In claims 1 and 21, columns 20, 21, and 22, replace the formulaes as follows:

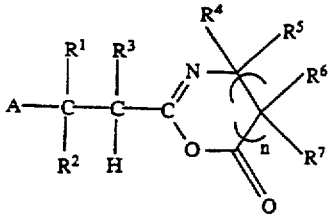

I

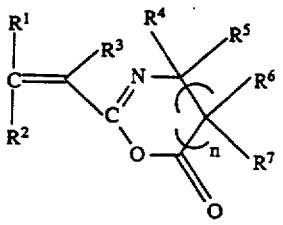

II

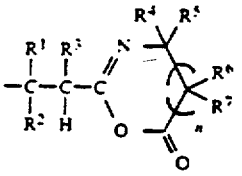

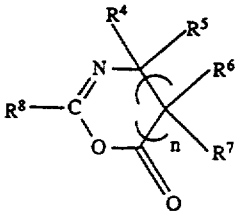

III

UNITED STATES PATENT AND TRADEMARK OFFICE

CERTIFICATE OF CORRECTION

PATENT NO. : 5,175,081

DATED : December 29, 1992

INVENTOR(S) : Krepski et al.

It is certified that error appears in the above-indentified patent and that said Letters Patent is hereby corrected as shown below:

Column 22, lines 31-45, replace the formulaes with the following:

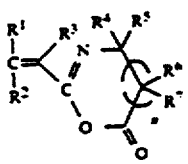

II

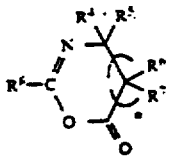

III

Signed and Sealed this

Thirteenth Day of September, 1994

*Attest:*

*Attesting Officer*

BRUCE LEHMAN

*Commissioner of Patents and Trademarks*